US006425712B1

(12) United States Patent
Vanderklaauw

(10) Patent No.: US 6,425,712 B1
(45) Date of Patent: Jul. 30, 2002

(54) METHOD AND APPARATUS FOR PROVIDING LATERAL SUPPORT TO A POST

(75) Inventor: Peter M. Vanderklaauw, Miami, FL (US)

(73) Assignee: Liftplate International, Miami, FL (US)

( * ) Notice: Subject to any disclaimer, the term of this patent is extended or adjusted under 35 U.S.C. 154(b) by 0 days.

(21) Appl. No.: 09/657,009

(22) Filed: Sep. 7, 2000

(51) Int. Cl.[7] ..... E02D 5/00

(52) U.S. Cl. ..... 405/230; 52/127.1; 52/127.2; 248/354.1

(58) Field of Search ..... 405/230; 248/354.1; 52/127.1, 127.2, 146, 148, 149, 114

(56) References Cited

U.S. PATENT DOCUMENTS

| | | | | |
|---|---|---|---|---|
| 2,983,342 | A | * | 5/1961 | Howard |
| 3,119,471 | A | * | 1/1964 | Turner |
| 3,828,513 | A | * | 8/1974 | Vanderklaauw |
| 3,920,780 | A | * | 11/1975 | Vanderklaauw |
| 4,800,690 | A | * | 1/1989 | Bunce |
| 4,832,315 | A | * | 5/1989 | Vanderklaauw |
| 4,980,999 | A | * | 1/1991 | Terenzoni |
| 5,575,591 | A | | 11/1996 | Vanderklaauw |
| 5,980,160 | A | * | 11/1999 | Vanderklaauw |

FOREIGN PATENT DOCUMENTS

WO WO92/01851 * 2/1992

* cited by examiner

*Primary Examiner*—David Bagnell
*Assistant Examiner*—Katherine Mitchell
(74) *Attorney, Agent, or Firm*—Jones, Tullar & Cooper, PC

(57) ABSTRACT

A method and apparatus for providing lateral support to a post includes a cage-like structure comprised of one or more modular cage units which are installed about the post. A plurality of guy wires are attached to the cage-like structure and anchored to the floor, ground, or the like, for providing lateral support to the post. Each cage unit includes a pair of main components with each main component including a pair of elongate generally parallel bar members. A lower connection bracket is attached to the bottom of each main component and includes a bolt hole for connecting the main component to a loading fame or other cage units. An upper connection bracket is attached to the top of each main component, and includes a bolt hole for connecting one main component to another main component placed on top thereof. The upper bracket also includes a pair of rod holes located near the free ends of the upper bracket for attaching a pivotable guy wire attachment fixture between two main components. The guy wires are attached to the attachment fixture and anchored to the ground for providing lateral support to the cage-like structure, and thereby to the post. A number of cage units may be stacked, one-upon-the-other to construct a cage-like structure of any desired height to provide lateral support to posts of various heights. In addition, the cage-like structure does not inhibit the upward extension of the post.

16 Claims, 6 Drawing Sheets

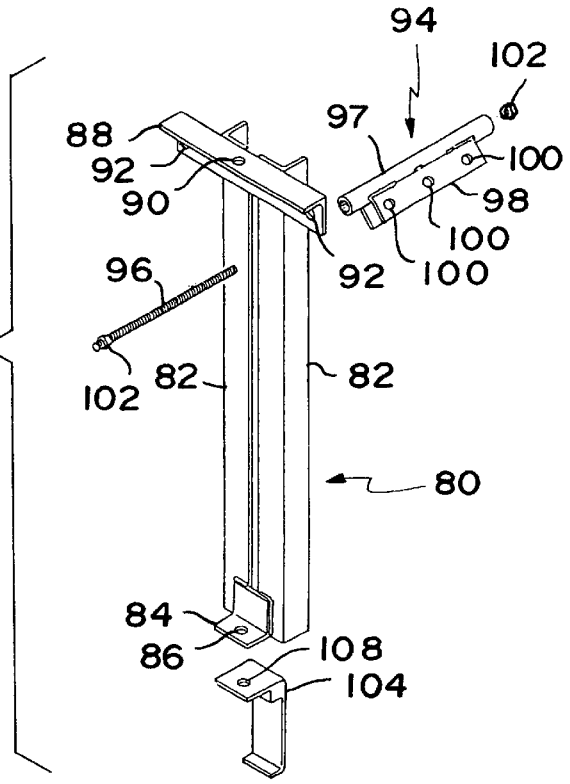
FIG. 4
FIG. 6b
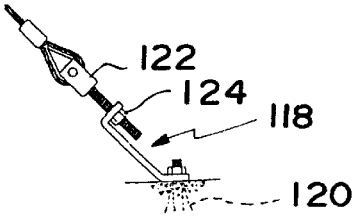
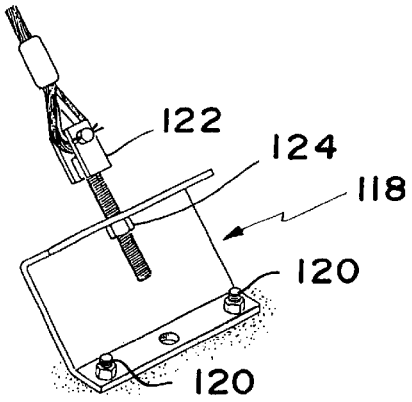
FIG. 6a
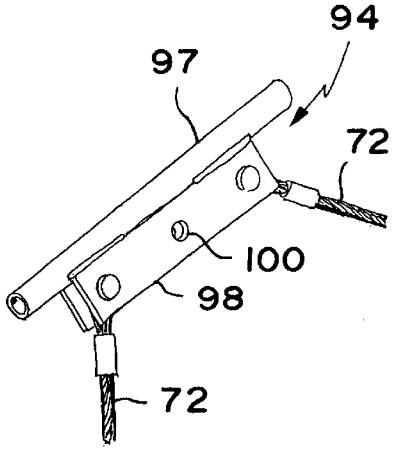
FIG. 5

METHOD AND APPARATUS FOR PROVIDING LATERAL SUPPORT TO A POST

BACKGROUND OF THE INVENTION

1. Field of the Invention

The present invention generally relates to a method and apparatus for laterally supporting a post. More particularly, this invention relates to a modular system which includes a plurality of elements which may be combined and installed to provide an elongate encircling cage-like structure for attaching guy lines which provide lateral support to a post located within the cage-like structure so that the post and a load supported by the post may be extended or elevated while still being laterally supported.

2. Description of the Prior Art

U.S. Pat. No. 5,575,591, to the same inventor as herein, the disclosure of which is incorporated herein by reference, sets forth an apparatus and method for a modular support and lifting system. Under this system a variety of support structures may be constructed by assembling a plurality of small similarly-configured building blocks, or cribs. The cribs are box-like metal building elements which can be bolted to each other to form posts or beams. The ends of the building elements are precision ground so that when the building elements are bolted together they form posts or beams which are perfectly straight and resistant to buckling.

One preferred use for the system of U.S. Pat. No. 5,575,591 is in the formation of a plurality of posts for supporting and raising structures, such as the roofs of buildings, bridges, machinery, and the like. To facilitate this raising function, hydraulic cylinders or jacks are incorporated into the posts and are used to progressively lift a load to a higher elevation. Special fixtures, loading frames, and cradles allow the installation of the hydraulic jacks within a post formed from a plurality of the building elements, and make it simple to pre-load the support system or lift the load to a higher elevation.

One advantage of this system is that the post may be extended progressively upward for an indefinite distance by adding new building elements to the post each time the load is lifted by extension of the hydraulic jack. However, because of this, as the post becomes longer and longer, at some point buckling of the post will become a concern. Accordingly, a method and apparatus are required which enable lateral support to be provided to such a post so that the post will not buckle, while still enabling further upward extension of the post. The method and apparatus in accordance with the present invention provide such lateral support in a safe, simple, and economical manner.

SUMMARY OF THE INVENTION

In the preferred form of the system of the invention there is set forth a method and apparatus for providing lateral support to a post. The apparatus includes a cage-like structure comprised of one or more modular cage units which are installed about a post. A plurality of guy wires are attached to the cage-like structure and anchored to the floor, ground, or the like, for providing lateral support to the post. Each cage unit includes a pair of generally T-shaped main components with each main component including a pair of generally parallel bar members. A lower connection bracket is attached to the bottom of each main component and includes a bolt hole for connecting the main component to a loading fame or other cage units. An upper connection bracket is attached cross-wise to the top of each main component, and includes a central bolt hole for connecting one main component to another main component placed on top thereof. The upper bracket also includes a pair of rod holes located near the free ends of the upper bracket for attaching a pivotable guy wire attachment fixture between two main components.

The guy wire attachment fixture includes a tubular member having a guy wire clevis mounted thereon for attaching guy wires to attachment points formed in the guy wire clevis. The pivotable guy wire attachment fixture is attached to the main component by inserting a threaded rod through the rod holes and the guy wire attachment fixture. The threaded rod is secured in place with nuts mounted on either end thereof. A second guy wire attachment fixture is similarly mounted on the opposite sides of the upper connection brackets and the post for creating a cage-like structure around the post.

A coupling bracket is also provided for enabling connection of the main components to the loading frame. The coupling bracket engages with the upper portion of the loading frame by placement between a pair of guide bars located on the loading frame. A bolt hole in the coupling bracket enables the lower bracket on the main component to be bolted to the coupling bracket.

Thus, a cage unit may be installed by placing a pair of coupling brackets between the guide bars on the loading fame and bolting a pair of main components to the coupling brackets. The guy wire attachment fixtures are attached between the main components by inserting the threaded rods through the rod holes and the tubular members, and nuts are used to retain the main components and the attachment fixtures in the assembled condition, thereby creating a cage-like structure which encircles the post in a sleeve-like manner.

Guy wires are then attached to the attachment points on the cage-like structure for providing lateral support to the post. Since the bar members on the main components extend inward over top of the guide bars, they contact the post and serve as guides and lateral supports for the post. One or more successive cage units may be constructed on top of a first cage unit. In this manner, the cage-like structure may be extended upward for an indefinite height, as necessary to support the post to a desired height. Anchoring brackets may be supplied for attaching the guy wires to the floor or ground.

Thus, the present invention sets forth a modular cage-like structure comprised of one or more cage units which may be constructed about a post to provide lateral support to the post. The cage-like structure may be constructed to an indefinite height by adding successive cage units to the top of the existing cage-like structure. The cage-like structure further has the advantage of enabling the post to be extended upward while still maintaining lateral support to the post. In addition, since the cage-like structure is modular, all components are reusable and may be transported, installed, and removed by hand.

BRIEF DESCRIPTION OF THE DRAWINGS

The foregoing and additional objects, features, and advantages of the present invention will become apparent to those of skill in the art from a consideration of the following detailed description of a preferred embodiment of the invention, taken in conjunction with the accompanying drawings.

FIG. 4 illustrates an exploded perspective view of the primary components of a modular cage unit in accordance with the present invention.

FIG. 5 illustrates one method of attaching guy wires to the apparatus of the invention.

FIGS. 6*a*–6*b* illustrate the anchoring bracket and attachment apparatus of the invention.

DETAILED DESCRIPTION

The present invention may be used in conjunction with a modular support and lifting system for meeting a variety of heavy lifting requirements, such as in the lifting of roofs, houses, buildings, structures, machinery, bridges, or the like. The lifting system employs a plurality of substantially similar building elements or "cribs". The building elements may be releasably connected to each other to form posts or beams. The ends of the building elements are preferably precision ground so that when a plurality of building elements are stacked and bolted together they form posts or beams which are perfectly straight and resistant to buckling.

Figures 1A, 1B, 1C:
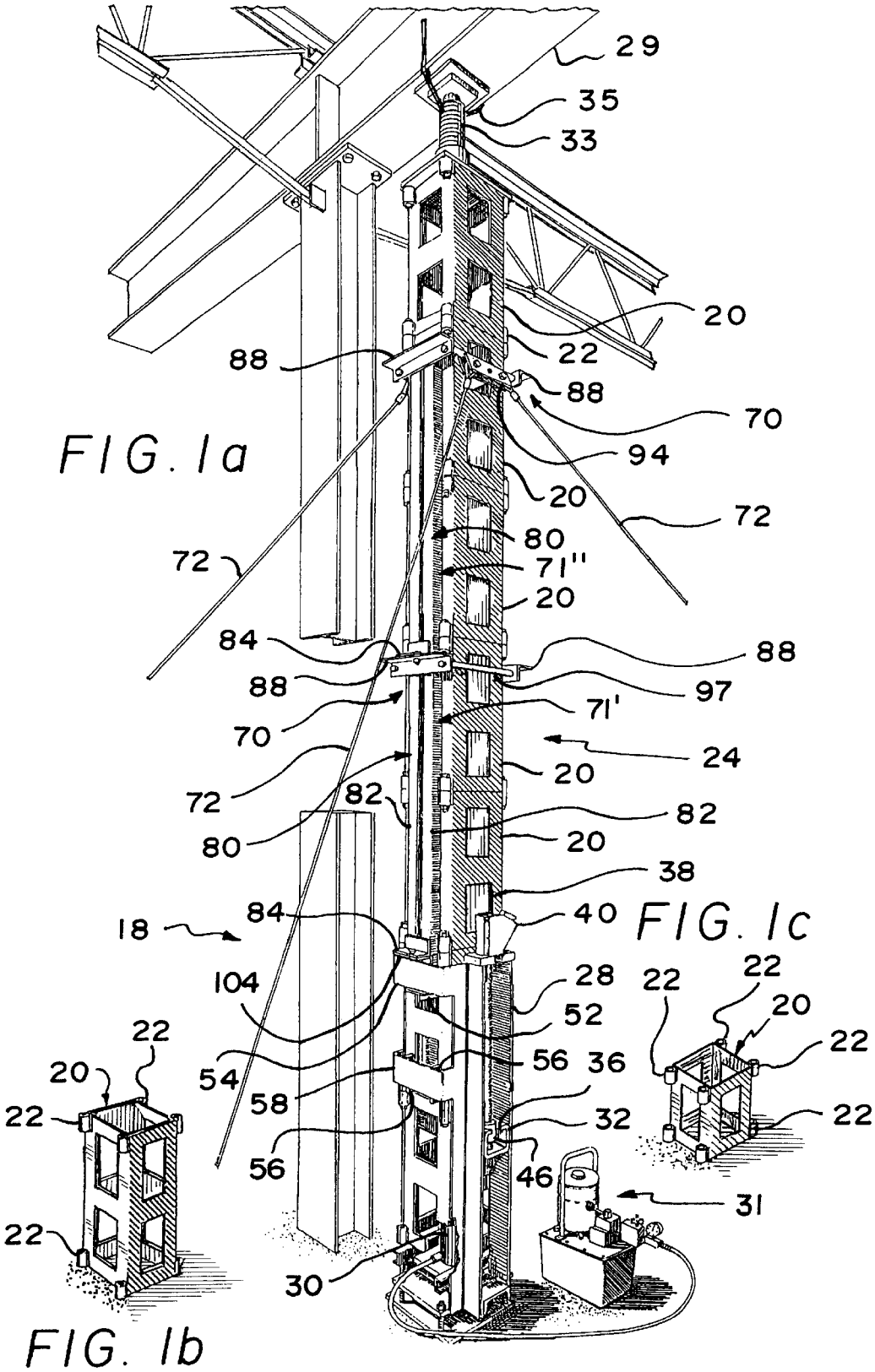
FIG. 1*a* illustrates a perspective view of the present invention in use with a vertically extensible post system.
FIGS. 1*b* and 1*c* illustrate building elements useable to form the vertically extensible post system.

FIG. 1*a* shows the present invention in use with a modular support and lifting system 18. Support and lifting system 18 includes a plurality of box-like building elements 20, which may be constructed in several various heights, as seen in FIGS. 1*a* and 1*b*. Each building element 20 is a precision cut and ground box-like member of structural steel or other suitable material. Each building element 20 also includes a plurality of mating lugs 22 for enabling building elements 20 to be bolted to other building elements 20 for forming elongate structures, such as posts or beams. When providing a vertical support and lifting function, a post 24 is constructed by assembling a plurality of building elements 20 to each other within a specially designed loading frame 28. Loading frame 28 acts generally as a sleeve for receiving building elements 20 and for guiding post 24 upward. A hydraulic jack 30 is located within loading frame 28, and by extending hydraulic jack 30, post 24 and its supported load 29 may be lifted to a new elevation. A hydraulic pump 31 is supplied for providing pressurized fluid to hydraulic jack 30.

Figures 2A, 2B, 2C, 2D, 2E:
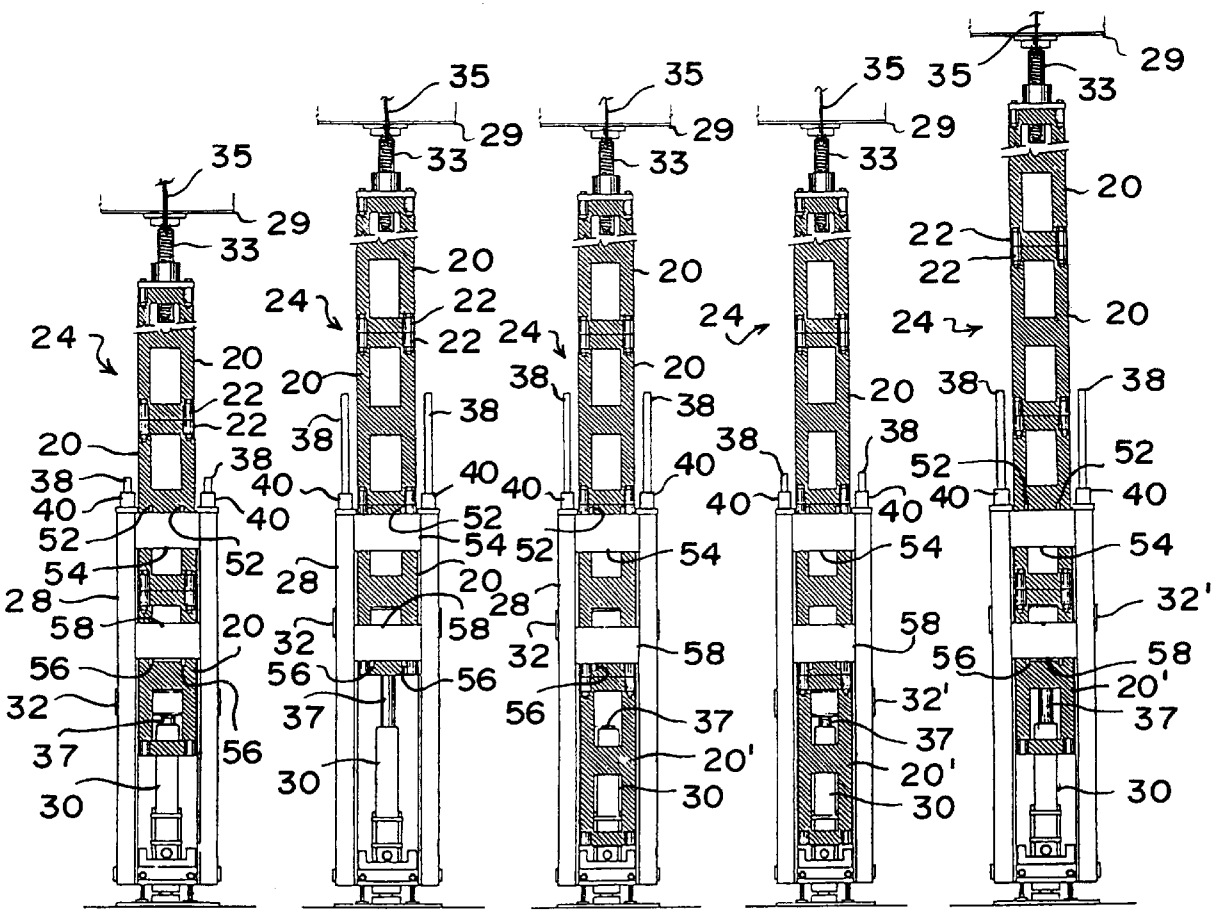
FIGS. 2*a*–2*e* illustrate how the post is extended using the extensible post system.

The function of support and lifting system 18 is further illustrated in FIGS. 2*a*–2*e* which show the basic steps in a lifting cycle. (The lateral support cage-like structure 70 of the present invention is omitted from FIGS. 2*a*–2*e* for clarity.) Post 24 is initially constructed with post 24 supported in loading frame 28 by a crossbar 32 and suspender rods 38, as illustrated in FIG. 2*a*. Crossbar 32 passes through openings in the bottom-most building element 20 and is supported by suspender rods 38 which are, in turn, supported by the top of loading frame 28. A screw jack 33 is fastened on top of post 24 and tightened against load 29. Screw jack 33 ensures that load 29 is concentric on post 24 and also enables a plurality of posts 24 to start with the same amount of piston stroke of hydraulic jack 30 at each lifting point. A safety strap 35 is placed around load 29 and through screwjack 33 to keep post 24 from shifting. In addition, the top plate of screw jack 33 may be tack welded to load 29 to prevent post 24 from shifting and to also prevent the lifting of load 29 by wind. The base of loading frame 28 may be bolted or otherwise anchored to the floor for the same reasons.

Figure 3:
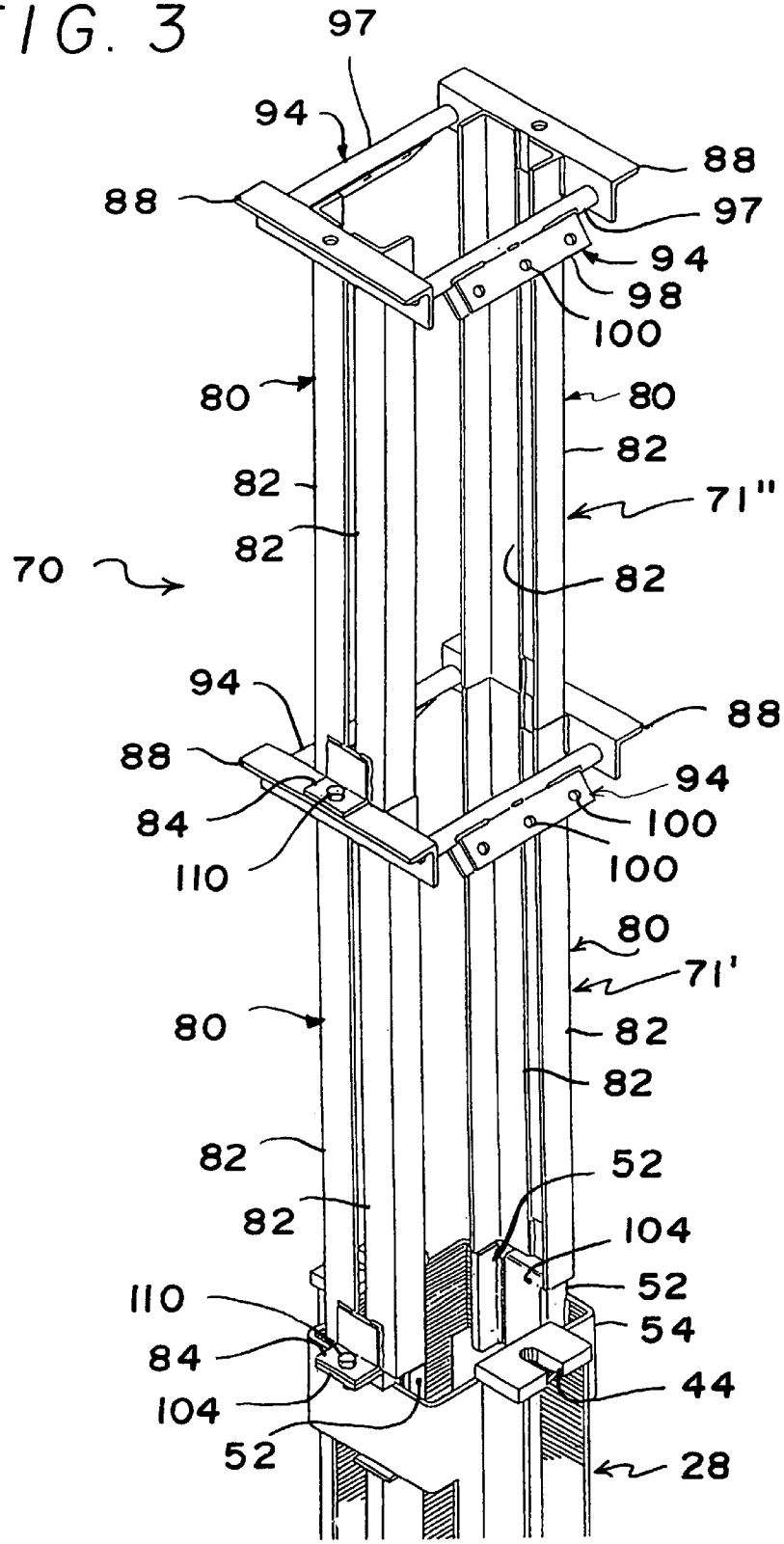
FIG. 3 illustrates a perspective view of the apparatus of the present invention installed on a loading frame.

Hydraulic jack 30 is installed under post 24 within loading frame 28, and hydraulic jack piston 37 is placed into contact with crossbar 32, as illustrated in FIG. 2*a*. To start lifting, piston 37 is extended until there is sufficient space below the bottom of post 24 to insert an additional building element 20, as illustrated in FIG. 2*b*. As jack 30 is extended, suspender rods 38 rise with crossbar 32 and post 24. Fall-back-prevention wedges 40 are located on top of loading frame 28 in contact with suspender rods 38. Fall-back-prevention wedges 40 allow suspender rods 38 to move upward as jack piston 37 is extended, but prevent downward movement of suspender rods 38 so as to prevent fall back of post 24 upon the release or failure of hydraulic pressure. At the bottom ends of suspender rods 38 there are located slotted holding nuts 46 for retaining suspender rods 38 within slots 36 in crossbar 32, thereby supporting crossbar 32. In addition, as illustrated in FIGS. 1 and 3, loading frame 28 further includes two opposed pairs of guide bars 52 mounted on the upper portion 54 of loading frame 28. Guide bars 52 extend inward toward post 24 and provide lateral support and guidance to post 24 within loading frame 28. Two additional opposed pairs of guide bars 56 may be included on the central portion 58 of loading frame 28 for providing additional guidance and support.

The elevation process is carried out by successively adding new building elements 20 to the bottom of post 24. Thus, when the stroke of jack 30 is complete, as illustrated in FIGS. 2*b*, and the hydraulic pressure is relieved, fall-back prevention wedges 40 and suspender rods 38 support the weight of post 24. In order for a subsequent building element 20' to be attached to the bottom of post 24, jack 30 is tilted outward and an additional building element 20' is placed over jack 30 and inserted under post 24, as illustrated in FIG. 2*c*. In this manner building elements 20 may be successively added to the bottom of post 24 as post 24 and load 29 are elevated. The additional building element 20' is bolted to the bottom of post 24, and a second crossbar 32' is inserted into the additional building element 20'. Jack piston 37 is pressurized against second cross bar 32' so that the first cross bar 32 may be removed and suspender rods 38 are then installed on second cross bar 32', as illustrated in FIG. 2*d*. Jack piston 37 may then be extended again for further elevating post 24 and load 29, as illustrated in FIG. 2*e*. It should be noted that lifting a roof or other structure is usually performed using a plurality of posts 24 located throughout a building. Thus, the extension of the jack pistons 37 on a plurality of posts may be controlled using an automated synchronization system, as set forth in U.S. Pat. Nos. 4,251,974 and 4,832,315, to the same inventor as herein, and the disclosures of which are incorporated herein by reference.

From the foregoing, it will be apparent that the support and lifting system 18 described above, and more fully described in U.S. Pat. No. 5,575,591, which has been incorporated herein by reference, provides a means for constructing an extensible post 24 which may be used to support and lift a load. The post 24 so constructed may be extended to practically any height. However, when extending post 24 to a greater and greater height, at some point buckling will become a concern. With the preferred embodiment of the support and lifting system 18, the maximum recommended unbraced length of post 24 under a full load of 25 tons is 24 feet. Beyond the length of 24 feet, post 24 must be laterally supported to prevent buckling. Accordingly, the present invention is directed to a method and apparatus for providing lateral support to such an extensible post 24 while still enabling post 24 to be further extended upwards. As illustrated in FIG. 1, a cage-like lateral support structure 70 comprised of one or more modular cage units 71 is installed about post 24. A plurality of guy wires 72 are attached to cage-like structure 70 and anchored to the floor, ground, or the like, for providing lateral support to post 24. Guy wires 72 may be standard lengths of cable having shop-fabricated swaged loops formed on each end.

FIG. 3 illustrates a perspective view of a first modular cage unit 71' of the invention mounted on a loading frame 28, and with a second cage unit 71" mounted on top of first cage unit 71'. FIG. 4 is an exploded perspective view which illustrates the individual primary elements of each modular cage unit 71. Each cage unit 71 includes a pair of generally T-shaped main components 80 having at least one elongate bar member 82, and, in the preferred embodiment, a pair of generally parallel bar members 82. Bar members 82 may be constructed out of steel angle bar stock or other suitable material. In the preferred embodiment, each main component 80 is 5 feet in length, although other lengths may also be used.

A lower connection bracket 84 is attached to the bottom of main component 80, by welding or other suitable means, for connecting bar members 82 to each other, and also includes a bolt hole 86 for connecting main component 80 to loading fame 28 or other cage units 71. An upper connection bracket 88 is transversely attached to the top of main component 80 by welding or other suitable means, thereby connecting to bar members 82, and includes a central bolt hole 90 for connecting one main component 80 to another main component 80 placed on top thereof. Upper bracket 88 also includes a pair of rod holes 92 located near the free ends of upper bracket 88 for attaching a pivotable guy wire attachment fixture 94.

Guy wire attachment fixture 94 includes a tubular member 97 having a guy wire clevis 98 mounted thereon for attaching guy wires 72 to attachment points or holes 100, as illustrated in FIGS. 1 and 5. Threaded rod 96 is inserted through rod hole 92 on a first main component 80, through tubular member 96, and through rod hole 92 on a second main component 80 for pivotally mounting guy wire attachment fixture 94 between a pair of main components 80, as illustrated in FIG. 3. Threaded rod 97 is secured in place with nuts 102 mounted on either end thereof. A second guy wire attachment fixture 94 is similarly mounted on the opposite sides of upper connection brackets 88, on the opposite side of post 24, for creating a cage-like structure 70. Guy wire attachment fixture 94 is pivotable to facilitate mounting of guy wires 72 at various angles relative to the vertical axis of post 24. Attachment fixture 94 preferably includes three attachment holes 100 along its length, with a pair of end holes and a center hole, the advantages of which arrangement will become apparent below.

A coupling bracket 104 is also provided for enabling connection of main component 80 to loading frame 28. Coupling bracket 104 engages with upper portion 54 of loading frame 28 by placement between guide bars 52. A bolt hole 108 on coupling bracket 104 enables lower bracket 84 on main component 80 to be bolted to coupling bracket 104 as illustrated in FIG. 3.

Thus, as illustrated in FIG. 3, a cage unit 71 may be installed on top of loading frame 28 by inserting a pair of coupling brackets 104 between guide bars 52. A pair of main components 80 are placed on top of coupling brackets 104 and are attached to coupling brackets 104 by bolts 110. Guy wire attachment fixtures 94 are attached between main components 80 by inserting threaded rods 96 through rod holes 92 and tubular members 97. If no guy wires are to be attached to a particular cage unit 71, then a tubular member 97 may be used without clevis 98, as illustrated with cage unit 71' in FIG. 1. Nuts 102 mounted on threaded rods 96 are used to retain main components 80 and attachment fixtures 94 in the assembled condition, thereby creating a cage-like lateral support structure 70 which encircles post 24 in a sleeve-like manner. Guy wires 72 are attached to attachment points 100, as illustrated in FIG. 1 for providing lateral support to post 24.

It may be seen that bar members 82 extend inward over top of guide bars 52 and contact post 24 to serve as guides and supports for post 24 in a manner similar to guide bars 52. The tolerances for constructing cage structure 70 are arranged so that bar members 82 are in sliding contact with post 24 as post 24 is extended upward so that lateral support is provided, but upward movement of post 24 is not inhibited. One or more successive cage structure units 71" may be constructed on top of a first cage structure unit 71' in a manner similar to that described above, with the exception that coupling brackets 104 are not required. Instead, lower connection bracket 84 on the successive cage unit 71" is bolted directly to upper connection bracket 88 on the previous cage unit 71' using bolts 110, as illustrated in FIG. 3. In this manner, cage-like structure 70 may be extended upward for an indefinite height, as required to support post 24 of a particular height.

Guy wires 72 may be anchored to the ground 116, generally a concrete slab or other load-supporting foundation, pylon, or the like. An anchoring bracket 118, as illustrated in FIGS. 6*a* and 6*b* may be used, and may be anchored to ground 116 using expansion bolts 120 or other suitable means. Anchoring brackets 118 may be supplied for attaching guy wires 72 at various angles, such as at 45 degrees, 60 degrees, or other suitable angle, depending on the height the attachment points 100 on cage-like structure 70 and the distance of anchoring brackets 118 from cage-like structure 70, although a 45 degree attachment angle is preferred. A clevis bolt 122 and nut 124 are used to tighten guy wires 72 to a desired tension. Tension in a plurality of guy wires 72 may be balanced by measuring the torque used to tighten nut 124, or by other known means, and should generally be equal in all guy wires 72 for a single post 24.

Figures 7A, 7B, 7C, 7D, 8A, 8B:
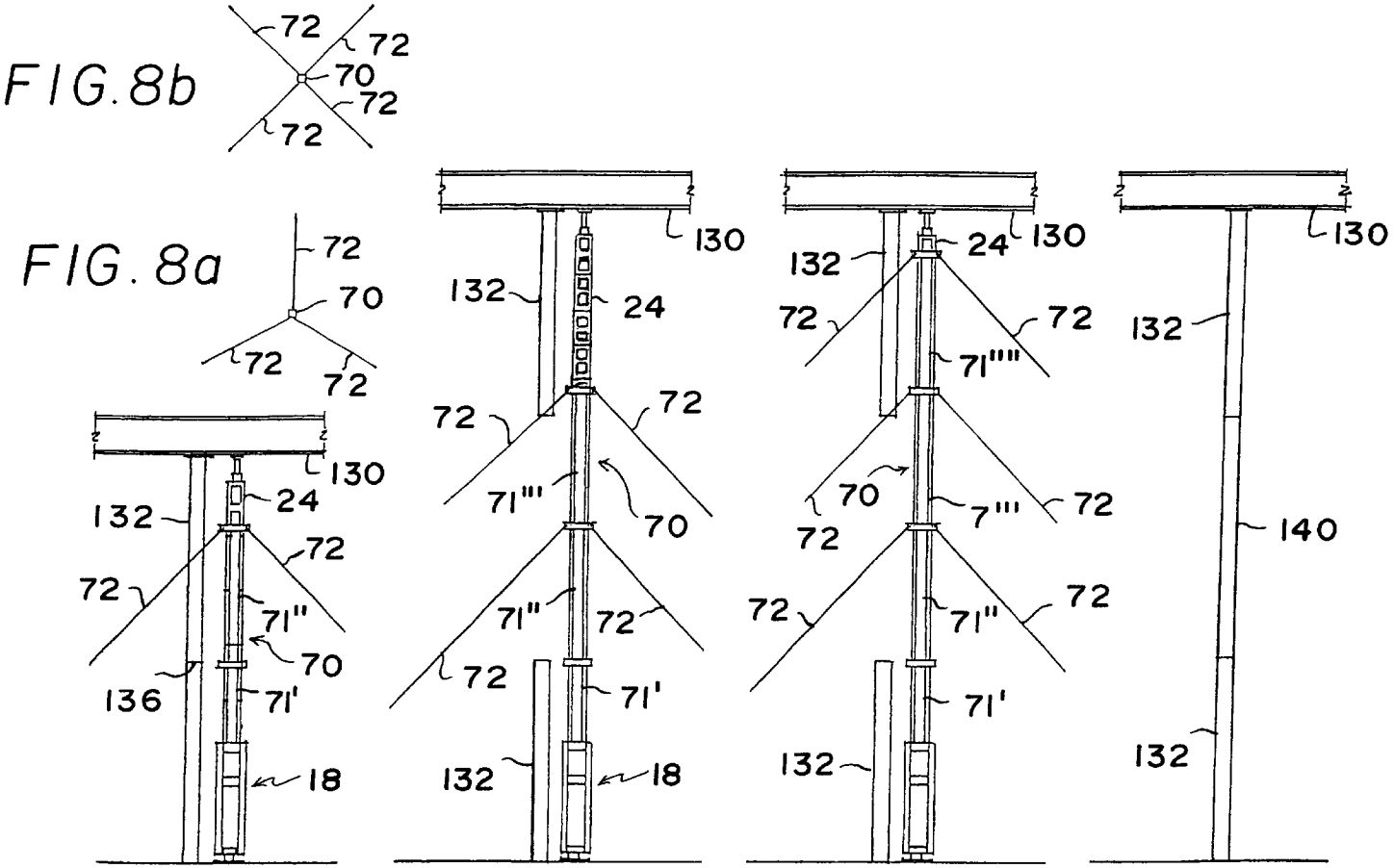
FIGS. 7*a*–7*d* illustrate the present invention in use during the elevation of a load.
FIGS. 8*a*–8*b* illustrate preferred attachment and anchoring angles for guy wires used to provide lateral support to the configuration of FIGS. 7*a*–7*b*.
Figures 9A, 9B, 9C, 9D, 10:
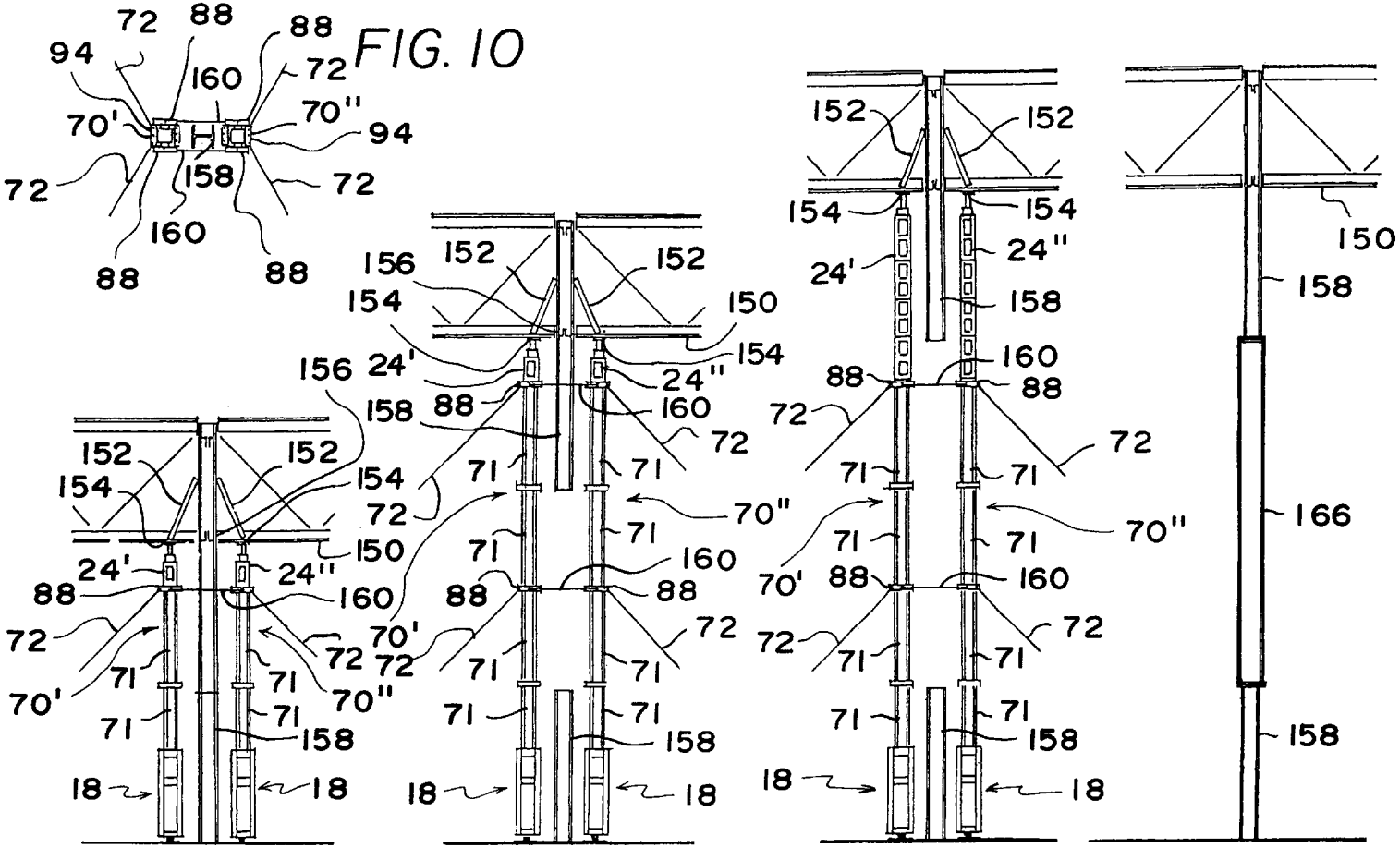
FIGS. 9*a*–9*d* illustrate a second method of use of the present invention for lifting a load.
FIG. 10 illustrates a preferred guy wire attachment and anchoring configuration for the apparatus of FIGS. 9*a*–9*d*.

FIGS. 7*a*–7*d* illustrate the method of using the invention during the elevation of a load 130, such as a roof of a building. Load 130 is initially supported at a first elevation by a column 132. However, it is desired that the roof (load 130) be elevated to increase the interior space in the building. Thus, as illustrated in FIG. 7*a,* post 24 is constructed in the manner described above so that post 24 supports the weight of load 130. First and second cage units 71' and 71" are installed about post 24 in the manner described above, thereby creating a cage-like structure 70, and guy wires 72 are attached to cage-like structure 70.

Guy wires 72 may be attached in either of the configurations illustrated in FIGS. 8*a* and 8*b*. In FIG. 8*a,* three guy wires 72 are attached to cage-like structure 70 in a configuration spaced 120 degrees apart from each other. This is the most efficient method of attaching guy wires 72 to cage structure 70, by providing lateral support with a minimum number of guy wires 72. In this manner, one guy wire 72 is attached to the central hole 100 on fixture 94 on one side of cage structure 70, while two guy wires 72 are attached to the end holes 100 on the attachment fixture 94 located on the opposite side of cage structure 70. Guy wires 72 are then attached to anchoring brackets 118 (not shown in FIGS. 7*a*–7*d*) and the tension in guy wires 72 must be equalized so that balanced lateral loads are impose on cage structure 70 by guy wires 72. A template (not shown) may be provided for determining proper placement of the anchoring brackets, or other measuring means may be used. As an alternative guy wire installation arrangement, four guy wires 72 may be used as illustrated in FIG. 8*b*. In this case, guy wires 72 are installed at approximately 90 degree angles from adjacent guy wires 72 and are all attached to the end holes 100 on attachment fixtures 94.

Once post 24 is in position to support load 130, post 24 is preloaded so that it is supporting load 130. Column 132 may then be severed as illustrated at 136. The elevation process may then take place, whereby successive building elements 20 are added to post 24. When a predetermined height is reached, an additional cage unit 71''' may be added to the top of cage structure 70, as illustrated in FIG. 7*b*, and additional guy wires 72 attached to the additional cage unit 71'''. As post 24 is extended further, yet another cage unit 71'''' may be added to the top of cage-like structure 70. This process is repeated as necessary until the desired new elevation has been reached. When the desired new elevation is reached, a new column section 140 may be welded or otherwise securely added to column 132 so that column 132 may again support load 130. Cage structure 70 and post 24 may then be disassembled leaving load 130 supported at the new elevation by column 132.

FIGS. 9*a*–9*d* illustrate a variation of the above-described method and system useful for lifting heavier loads, space-frame-type loads, or suspended loads 150. Kickers 152 are installed above the bearing points 154 of posts 24 so that stress concentrations are avoided on the space frame joints 156 attaching to column 158. A first post 24' and a second post 24" are constructed in the manner described above, and a cage-like structure 70', 70" is constructed about each post 24', 24", respectively, as described above. However, in the variation, the first cage structure 70' is connected to the second cage structure 70" by lateral cables 160. Lateral cables 160 are connected to upper brackets 88 by bolts, or the like, to prevent lateral movement of first post 24' away from second post 24". Guy cables 72 are then attached to the fixtures 94 facing outward, as illustrated in FIG. 10.

Posts 24', 24" are then extended in the manner described above, thereby elevating load 150. Additional cage units 71 are added to cage structures 70', 70", as posts 24', 24" are extended. When the desired height is reached, a new column segment 166 is added to column 158. In the embodiment shown, new column segment 166 is larger in cross section than original column 158. This serves to prevent buckling of the new structure comprised of original column 158 and new column segment 166. Posts 24', 24" and cage structure 70', 70" may then be disassembled and removed. Kickers 152 may be removed or left in place, as desired.

From the foregoing it will be apparent that the present invention sets forth a method and apparatus for providing lateral support to one or more posts 24 for preventing buckling, sideward movement, or the like. The present invention includes a sleeve-like cage structure that enables the posts 24 to be extended upward or retracted downward while still maintaining the lateral support. The modular design of the system allows the creation of posts and post-support structures of practically any desired height. In addition, the modular design enables the components to be reused again and again on various different types of projects, without requiring any job-specific modifications to the equipment. Also, because of the modular design, all components of the present invention may be transported, installed and removed by hand, without requiring any heavy lifting equipment or special tools.

Accordingly, while preferred embodiments of a method and apparatus for a modular lateral support system in accordance with the present invention have been set forth fully and completely herein, it will be apparent to one of skill in the art that a number of changes in, for example, the sizes and shapes of the various components, the materials used, the configurations constructed, and the like can be made without departing from the true spirit and scope of the present invention, which is to be limited only by the following claims.

What is claimed:

1. A method for providing lateral support to an extensible post during extension of the post, said method including:

providing a modular cage-like structure;

surrounding a portion of the extensible post with said modular cage-like structure;

forming a sleeve surrounding the extensible post using said modular cage-like structures with the post being extensible in said sleeve formed surrounding the post using said modular cage-like structures;

increasing a length of said sleeve by using said modular cage-like structures during extension of the post;

including attachment points for connecting a plurality of guy wires to said modular cage-like structure;

providing a plurality of elongate guy wires, each said guy wire having a first end and a second end;

connecting said first end of each said guy wire to said modular cage-like structure at one of said attachment points; and connecting said second end of each said guy wire to an anchor, whereby said guy wires provide lateral support to said sleeve and to the extensible post being surrounded by said increasing length sleeve formed using said modular cage-like structure during extension of the post within said increasing length sleeve.

2. The method of claim 1 wherein said modular cage-like structure is provided as one or more modular units, and further including the step of adding additional modular units to the top of said sleeve for providing attachment points for said elongate guy wires at a higher elevation of said sleeve during extension of the post.

3. The method of claim 1 further including the step of telescopingly extending the post within said sleeve while lateral support for said sleeve and the post is provided by said elongate guy wires.

4. The method of claim 1 further including the steps of providing two main components and assembling said modular cage-like structure by joining said two main components on opposite sides of the post.

5. The method of claim 1 further including the steps of providing three of said elongate guy wires and anchoring said elongate guy wires approximately 120 degrees apart from each other.

6. The method of claim 1 further including providing a loading frame, supporting a base of the post in said loading frame and securing said modular cage-like structure to said loading frame.

7. An apparatus adapted to provide lateral support to an extensible post during extension of the post, said apparatus comprising:

a modular cage unit, said modular cage unit being adapted to be constructed about the extensible post and to form a sleeve-like structure about the post, the post being extensible in an upward direction with respect to said sleeve-like structure formed by said modular cage unit, and said sleeve-like structure increasing in length during the extension of the post; and guy wire attachment points on said modular cage unit for attaching guy wires to said modular cage unit, said guy wires providing lateral support to said modular cage unit, said modular cage unit providing lateral support to the post while allowing the post to be extensible within said modular cage unit.

8. The apparatus of claim 7 wherein a plurality of said modular cage units are constructed about the post, one on top of the other, for providing said increasing length sleeve to provide lateral support to the post at a location higher up on the post as the post is extended.

9. The apparatus of claim 7 wherein each said modular cage unit includes a pair of main components, said pair of main components being located on opposite sides of the post from each other, and a pair of attachment fixtures located on opposite sides of the post from each other and connected between said pair of main components.

10. The apparatus of claim 7 further including a loading frame, said loading frame being adapted to support a base of the post, said modular cage unit being attached to said loading frame.

11. A method for providing lateral support to an extensible post during extension of the post, said method including:

providing a plurality of modular cage units;

assembling each said cage unit to encircle the extensible post in a sleeve-like manner for contacting the post to provide lateral support to the post;

constructing said cage units being stackable on upon the other for constructing a lateral support structure of increasing height for encircling the post in said sleeve-like manner while allowing the post to be extensible in a telescoping manner within said lateral support structure;

providing guy wires;

providing guy wire anchor points spaced away from the post; and attaching said guy wires to at least one of said plurality of modular cage units and to said anchor points whereby said guy wires provide lateral support to said lateral support structure and thereby to the post being encircled by said plurality of modular cage units during the telescopic extension of the post within said increasing height lateral support structure.

12. The method of claim 11 further including the step of telescopingly extending the post within said increasing height lateral support structure while lateral support is provided to the telescopingly extending post and to said increasing height lateral support structure by said guy wires.

13. The method of claim 11 further including the step of adding an additional one of said modular cage units to a top of said increasing height lateral support structure for providing attachment points for said guy wires at a higher elevation.

14. The method of claim 11 further including the step of providing two main components and assembling said lateral support structure by assembling said two main components on opposite sides of the post.

15. The method of claim 11 further including the steps of providing three of said guy wires and anchoring said guy wires approximately 120 degrees apart from each other.

16. The method of claim 11 further including providing a loading frame, supporting a base of the post in said loading frame and securing a lower one of said stackable cage units to said loading frame.

* * * * *